US010519690B2

(12) United States Patent
Harrop-Allin

(10) Patent No.: US 10,519,690 B2
(45) Date of Patent: Dec. 31, 2019

(54) BARB TAPE AND BARB TAPE PANEL

(71) Applicant: George Anton Harrop-Allin, Johannesburg (ZA)

(72) Inventor: George Anton Harrop-Allin, Johannesburg (ZA)

( * ) Notice: Subject to any disclaimer, the term of this patent is extended or adjusted under 35 U.S.C. 154(b) by 0 days.

(21) Appl. No.: 16/070,680

(22) PCT Filed: Dec. 1, 2016

(86) PCT No.: PCT/ZA2016/050050
§ 371 (c)(1),
(2) Date: Jul. 17, 2018

(87) PCT Pub. No.: WO2017/143364
PCT Pub. Date: Aug. 24, 2017

(65) Prior Publication Data

US 2019/0032362 A1 Jan. 31, 2019

(30) Foreign Application Priority Data

Feb. 17, 2016 (ZA) ..... 2016/01100

(51) Int. Cl.
*E04H 17/04* (2006.01)
*B21F 25/00* (2006.01)
*F41H 11/08* (2006.01)

(52) U.S. Cl.
CPC ..... *E04H 17/04* (2013.01); *B21F 25/00* (2013.01); *F41H 11/08* (2013.01); *Y10T 29/20* (2015.01)

(58) Field of Classification Search
CPC ..... B21F 25/00; E04H 17/04; F41H 11/08; Y10T 29/20
USPC ..... 256/2, 5–9; 29/7.1
See application file for complete search history.

(56) References Cited

U.S. PATENT DOCUMENTS

| | | | | |
|---|---|---|---|---|
| 4,509,726 A * | 4/1985 | Boggs | F41H 11/08 | 256/2 |
| 4,666,129 A * | 5/1987 | Dobson | E04H 17/04 | 256/2 |
| 6,601,830 B1 * | 8/2003 | Pavlov | B21F 25/00 | 256/2 |
| 8,851,456 B2 * | 10/2014 | Kosedag | B21F 25/00 | 256/8 |
| 2007/0138454 A1 * | 6/2007 | Yeo | E04H 17/04 | 256/2 |

FOREIGN PATENT DOCUMENTS

| | | | |
|---|---|---|---|
| DE | 8120085 U1 * | 9/1981 | E04H 17/04 |
| EP | 2251116 | 11/2010 | |
| GB | 2039683 | 8/1980 | |
| WO | 2013136164 | 9/2013 | |

OTHER PUBLICATIONS

Search Report and Written Opinion dated Apr. 13, 2017 in international application serial No. PCT/ZA2016/050050.

* cited by examiner

*Primary Examiner* — Josh Skroupa
(74) *Attorney, Agent, or Firm* — Haugen Law firm PLLP

(57) ABSTRACT

A barb tape (10) includes: (i) a first wire (14, 114); (ii) a second wire (16, 116) that is spaced from, and extends substantially parallel to the first wire (14, 114); and (iii) an elongate strip material (12, 112) defining: a spine (18, 118) and a plurality of barbs (22, 122) extending from at least one major edge (20) of the spine (18, 118), wherein the spine (18, 118) crimps the first (14, 114) and second (16, 116) wires.

9 Claims, 4 Drawing Sheets

BARB TAPE AND BARB TAPE PANEL

BACKGROUND

The present invention relates to a barb tape. More particularly, the invention relates to a barb tape including a pair of parallel wires.

Barb tapes are known. For instance, U.S. Pat. No. 4,509,726 "Barrier", U.S. Pat. No. 5,109,583 "Method of manufacturing barbed tape", U.S. Pat. No. 5,401,002 "Barb stiffening process and product" and ZA99/2967 "Barb tape" describe a barb tape comprising a strip material and a single wire, wherein the wire extends axially along the strip material and is crimped thereby.

A drawback of known barb tape is that they are not easily welded to each other to form a panel—only two relatively narrow strips of barb tape extending from the axially extending wire may be used to spot weld overlapping transverse barb tapes to each other.

It is an object of the present invention to address this drawback.

SUMMARY OF THE INVENTION

According to a preferred embodiment of a first aspect of the present invention there is provided a barb tape that includes:

- a first wire;
- a second wire that is spaced from, and extends substantially parallel to the first wire;
- an elongate strip material defining:
  - a spine; and
  - a plurality of barbs extending from at least one major edge of the spine, wherein the spine crimps the first and second wires.

Preferably, the spine is substantially planar.

Typically, the major edges of the spine are substantially parallel.

Generally, the first and second wires are spaced a distance more than half the width of the spine.

Preferably, the first and second wires are spaced between 10 mm and 20 mm.

Optionally, the first and second wires are crimped along the major edges of the spine.

Alternatively, the spine defines: (i) a first flange that extends laterally from the first wire, away from the second wire; and (ii) a second flange that extends laterally from the second wire, away from the first wire.

Typically, the first flange defined by the spine, the second flange defined by the spine, and the spine portion extending between the first and second wires lie substantially in the same plane.

The first and second flanges defined by the spine may be between 2 mm and 5 mm in width.

Generally, the first and second wires are arranged symmetrically about the longitudinal axis of the strip material.

Preferably, a plurality of barbs extend from both major edges of the spine.

Typically, the barbs comprise sets of opposing pairs of barbs that share a common shaft that extends laterally from the spine.

Generally: (i) the shafts of adjacent sets of barbs along a first major edge of the spine are spaced less than 85 mm apart; and (ii) the shafts of adjacent sets of barbs along a second major edge of the spine are spaced less than 85 mm apart.

Preferably, the shafts of the barbs along the first major edge of the spine are aligned with the shafts of the barbs along the second major edge.

Typically, the sets of barbs are substantially equi-spaced along the spine.

According to a preferred embodiment of a second aspect of the present invention, a barb tape panel comprising at least two barb tapes according to the first aspect of the invention that are: (i) oriented transverse to each other; and (ii) welded, riveted, stapled, hog-ringed, clipped, adhered or crimped to each other at points of intersection in the region of the spine between the first and second wires.

BRIEF DESCRIPTION OF THE DRAWINGS

The aspects of the invention will now be described in more detail, by way of examples only, with reference to the accompanying drawings in which.

In this specification, "wire" means an elongate metal body that is formed by drawing, cutting, rolling or stamping.

DESCRIPTION OF THE INVENTION

Figure 1:
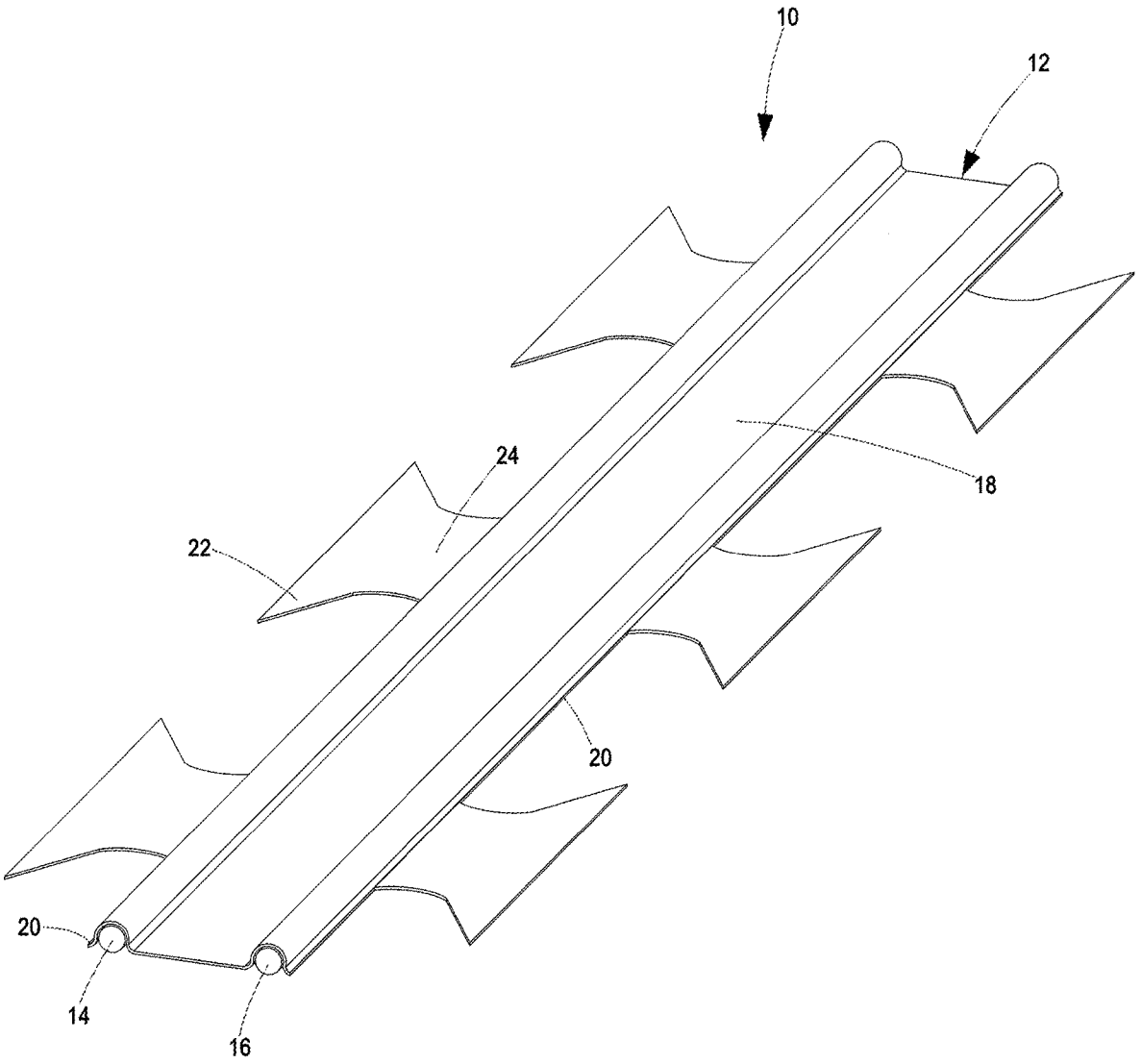
FIG. 1 is a top perspective view of a barb tape according to a preferred embodiment of a first aspect of the invention.
Figure 2:
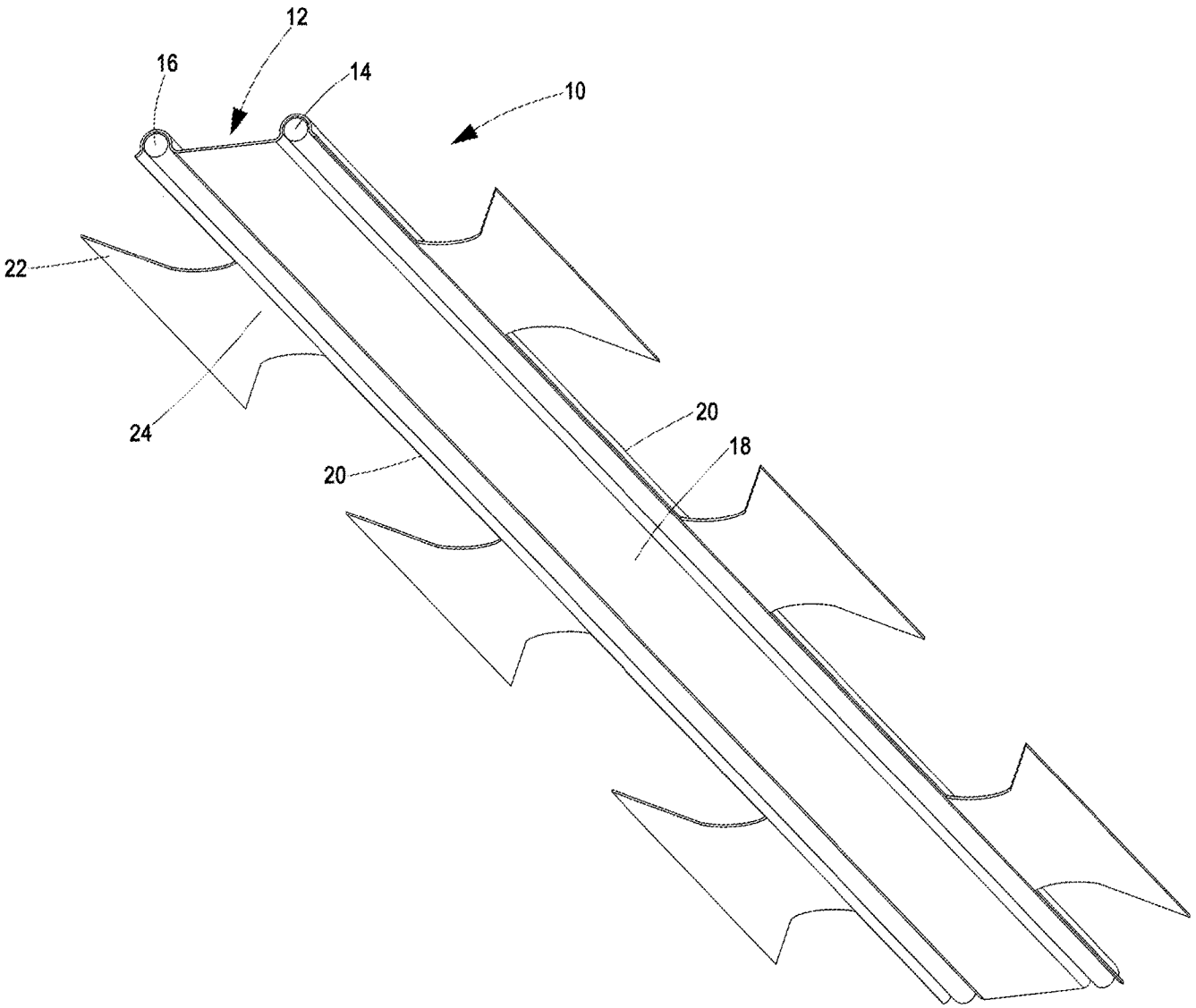
FIG. 2 is a bottom perspective view of the barb tape in FIG. 1.

With reference to FIGS. 1 and 2, according to a preferred embodiment of a first aspect of the invention a barb tape 10 includes an elongate strip material 12, a first wire 14 and a second wire 16.

The elongate strip material 12 comprises a substantially planar spine 18 that extends axially along the elongate strip material 12. The spine 18 is between 20 mm and 50 mm in width, defining substantially parallel major edges 20 (i.e. the major edges of the spine 18 are angularly offset from parallel by no more than 5 degrees) and, although the spine 18 has been shown with linear major edges 20, these edges 20 may undulate along the length of the spine 18. Preferably, the spine 18 is either 12.2 mm or 18.8 mm in width (i.e. the major edges of the spine 18 are spaced 12.2 mm or 18.8 mm). The spine 18 may be of any length (typically more than 200 mm), is made of a steel sheet that is between 1 mm and 3 mm in thickness. It will be appreciated that, although the spine 18 has been described as being substantially planar, the spine 18 in axial cross section could alternatively be V-shaped.

The elongate strip material 12 also defines a plurality of barbs 22 that terminate in a sharp point. The barbs 22 extend from both major edges 20 of the spine 18 and are arranged in sets of opposing pairs of barbs 20 that share a common shaft 24 that extends laterally from the spine 18. FIGS. 1 and 2 show each pair of barbs 22 extending from the free end of the shaft 24 in a direction substantially parallel to the axis of the spine 18. The pointed end of each barb 12 is laterally spaced between 5 mm and 8 mm from the major edge 20 of the spine 18, and the opposed pointed ends of each set of barbs 22 are spaced between 25 mm and 35 mm from each other. Furthermore, adjacent shafts 24 along the same major edge 20 of the spine 18 are spaced between 40 mm and 85 mm, preferably 50 mm. In other words, the centreline of adjacent shafts 24 are spaced between 40 mm and 85 mm, preferably 50 mm. The shafts 24 and barbs 22 are arranged symmetrically about the longitudinal axis of the strip material 12, i.e. the shafts 24 and barbs 22 along a first major edge 20 of the spine 18 are aligned with the shafts 24 and barbs 22 along the second major edge 20 of the spine 18. And, the shafts 24/sets of barbs 22 are substantially equi-spaced along the spine 18.

The first and second wires 14 and 16, which are made of high tensile steel, are spaced from, and extend substantially parallel to each other. FIGS. 1 and 2 show the wires 14 and 16 crimped by the elongate strip material 12 along the major edges 20 of the spine 18. Although the barb tape 10 has been described as including only first and second wires 14 and 16, it will be appreciated that the barb tape could include additional third and fourth wires, in which instance the width of the spine 18 will likely exceed 18.8 mm in width).

Figure 3:
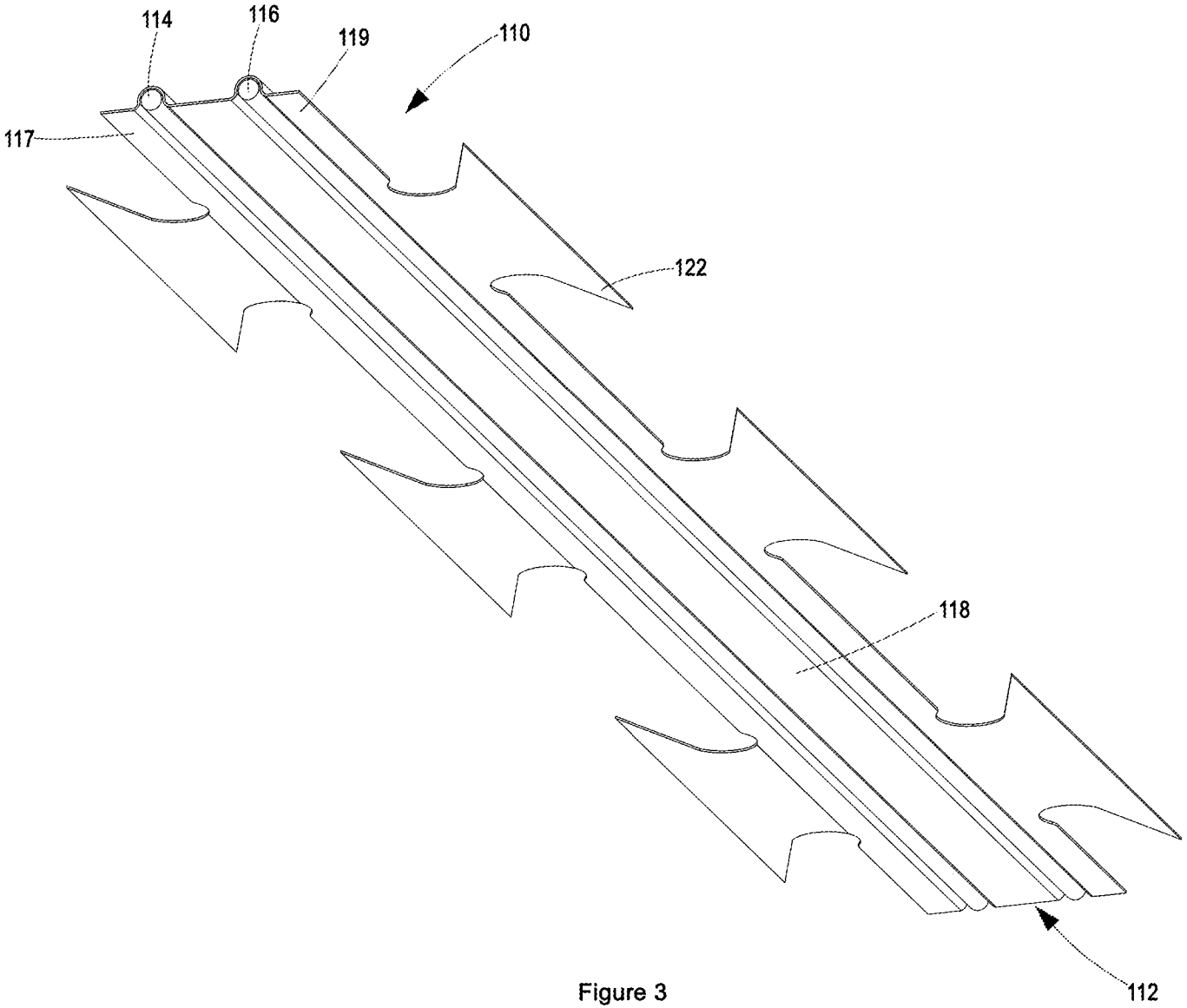
FIG. 3 is a bottom perspective view of a barb tape according to an alternative embodiment of the first aspect of the invention.
Figure 4:
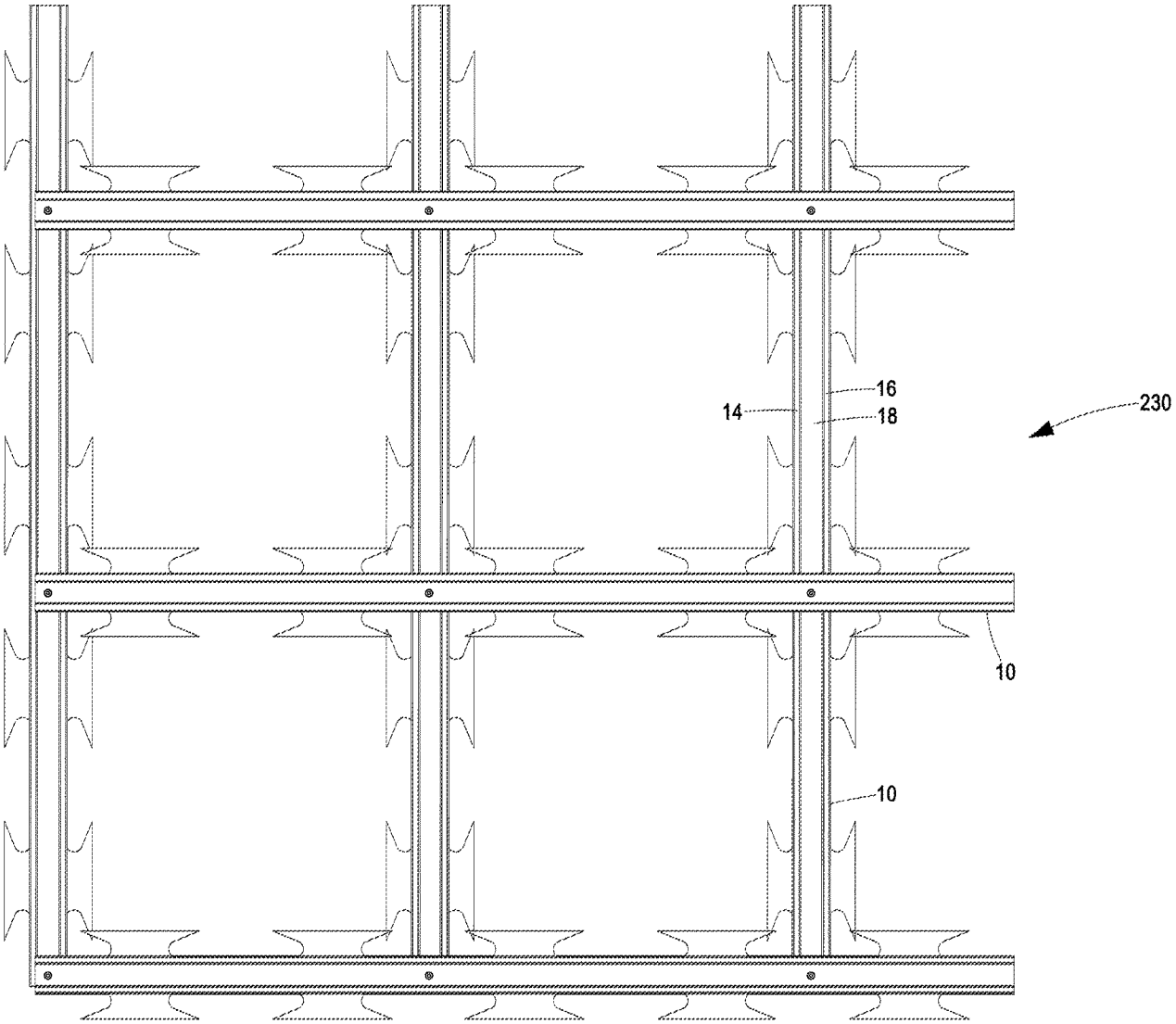
FIG. 4 is a plan view of a welded barb tape panel according to a second aspect of the invention comprising barb tapes in FIG. 1 welded to each other.

FIG. 3 shows an alternative embodiment of the barb tape 110. This alternative embodiment is similar to the first embodiment of the barb tape 10, however, whereas the wires 14 and 16 in the first embodiment are crimped to the elongate strip material 12 along the major edges 20 of the spine 18, the wires 114 and 116 in the alternative embodiment are crimped by the elongate strip material 112 inwards of the major edges 120 of the spine 118. Preferably, the wires 114 and 116 are arranged symmetrically about the longitudinal axis of the elongate strip material 12 and are spaced from each other a distance more than half the width of the spine 118. In this alternative arrangement, the spine 118 defines: (i) a first flange 117 that extends between 2 mm and 5 mm laterally from the first wire 114, away from the second wire 116; and (ii) a second flange 119 that extends between 2 mm and 5 mm laterally from the second wire 116, away from the first wire 114. In other words, each of the first and second flanges 117 and 119 are between 2 mm and 5 mm in width. Since the spine 118 is generally planar, the first flange 117, the second flange 119, and the spine 118 portion extending between the first and second wires 114 and 116 lie substantially in the same plane.

A barb tape panel 230 according to a second aspect of the invention is made using barb tape 10 according to the preferred embodiment of the first aspect of the invention. It will be appreciated that the barb tape panel 230 may alternatively be made using barb tape 110 according to the alternative embodiment 110 of the first aspect of the invention.

The barb tape panel 230 comprises a first array of parallel barb tapes 10 and a second array of parallel barb tapes 10, which second array of parallel barb tapes 10 are angularly offset relative to, and overlap the first array of parallel barb tapes 10, defining points of intersection between barb tapes 10 in the first array and barb tapes 10 in the second array. The barb tapes 10 are welded to each other at their points of intersection in the region of the spine 18 between the first and second core wires 14 and 16. Such welded portion could extend to (and include) the wires 14 and 16. It will also be appreciated that as an alternative to welding the barb tapes 10 to each other at their points of intersection, the barb tapes 10 could be riveted, stapled, hog-ringed, clipped, adhered or crimped to each other.

It will be appreciated that since the core wires 14 and 16 are disposed along the major edges 20 of the spine 18, the spine 18 provides a relative wide planar, unbroken region between the wires 14 and 16 to facilitate spot welding. In contrast, should a wire 14 or 16 be arranged along the axis of the spine 18 (as per prior art barb tapes), it will be appreciated that the wire 14 or 16 would break the planar region of the spine into two, providing two relatively narrow regions (instead of a relative wide, singe region) for welding.

Furthermore, by incorporating a second wire 16 and 116: the rigidity of the barb tape 10 and 110 is increased; the resistance of the barb tape 10 and 110 to being cut is increased; the barb tape 10 and 110 appears to be more bulky, increasing the visual deterrence of the barb tape 10 and 110; the barb tape 10 and 110 is less susceptible to bending and deformation during installation and handling/forming of a barb tape panel 230; the diameter of the wires 14, 114, 16, 116 may be decreased (while maintaining the same strength as a barb tape with a single wire); and the thickness of the elongate strip material 12 and 112 may be reduced (while maintaining the same strength as a barb tape with a single wire). By enabling a decrease in the thickness of the elongate strip material 12 and 112, the sharpness of the barbs 22 and 122 may thereby be increased.

The invention claimed is:

1. A barb tape including:
- a first wire;
- a second wire that is spaced from, and extends substantially parallel to the first wire;
- an elongate strip material defining:
  - a spine that extends between the first and second wires;
  - a first flange that extends laterally from the first wire, away from the second wire;
  - a second flange that extends laterally from the second wire, away from the first wire; and
  - a plurality of barbs extending from at least one of the first flange and the second flange,
- wherein:
  - the first flange, the second flange and the spine lie substantially in the same plane; and
  - the strip material crimps the first and second wires.

2. A barb tape according to claim 1, wherein the first and second wires are spaced between 10 mm and 20 mm.

3. A barb tape according to claim 2, wherein each of the first and second flanges is between 2 mm and 5 mm in width.

4. A barb tape according to claim 3, wherein the first and second wires are arranged symmetrically about the longitudinal axis of the strip material.

5. A barb tape according to claim 4, wherein a plurality of barbs extend from both the first flange and the second flange.

6. A barb tape according to claim 5, wherein the barbs comprise sets of opposing pairs of barbs that share a common shaft that extends laterally from the first and second flanges.

7. A barb tape according to claim 6, wherein:
- the shafts of adjacent sets of barbs along the first flange are spaced less than 85 mm apart;
- the shafts of adjacent sets of barbs along the second flange are spaced less than 85 mm apart; and
- the shafts of the barbs along the first flange are aligned with the shafts of the barbs along the second flange.

8. A barb tape according to claim 7, wherein the sets of barbs are substantially equi-spaced along the strip material.

9. A barb tape panel comprising at least two barb tapes according to claim 1 that are: (i) oriented transverse to each other; and (ii) welded, riveted, stapled, hog-ringed, clipped, adhered or crimped to each other at points of intersection in the region of the spine between the first and second wires.

* * * * *